United States Patent [19]

Robillard

[11] 4,320,193

[45] Mar. 16, 1982

[54] PHOTOGRAPHIC EMULSIONS HAVING SPECIAL CHROMATIC EFFECTS

[75] Inventor: Jean J. Robillard, Pelham, Mass.

[73] Assignee: Bristol-Myers Company, New York, N.Y.

[21] Appl. No.: 151,806

[22] Filed: May 21, 1980

[51] Int. Cl.[3] ..... G03C 1/76

[52] U.S. Cl. ..... 430/503; 430/383; 430/504

[58] Field of Search ..... 430/502, 503, 504, 505, 430/506, 508, 383

[56] References Cited

U.S. PATENT DOCUMENTS

| | | | |
|---|---|---|---|
| 2,319,984 | 5/1943 | Gaspar | 430/375 |
| 2,763,549 | 9/1956 | Hanson | 430/503 |
| 3,163,533 | 12/1964 | Derr | 430/508 |
| 3,490,904 | 1/1970 | Johnson et al. | 430/505 |
| 3,658,536 | 4/1972 | Wolf | 430/506 |
| 3,706,556 | 12/1972 | Nagae et al. | 430/359 |
| 3,844,784 | 10/1974 | Shimada et al. | 430/359 |
| 4,131,464 | 12/1978 | Silverman | 430/367 |

OTHER PUBLICATIONS

Spencer, "Colour Photography in Practice", pp. 63–64, Focal Press, New York, 1966.

Harwood, Perspective, vol. 6, No. 3, pp. 144–153, 1964.

*Primary Examiner*—J. Travis Brown

*Attorney, Agent, or Firm*—Sherman & Shalloway

[57] ABSTRACT

A color photographic element having special chromatic effects is disclosed, the element comprising a support and three emulsion layers. Special chromatic effects are obtained by particular combinations of the sensitizers and couplers contained in the emulsion layers, the combinations being different from conventional.

6 Claims, No Drawings

PHOTOGRAPHIC EMULSIONS HAVING SPECIAL CHROMATIC EFFECTS

BACKGROUND OF THE INVENTION

The present invention relates to color photography and particularly to color photography having special chromatic effects.

Color photography is based on the fact that the human eye is essentially receptive to three basic colors: blue (between 400 and 500 millimicrons), green (between 500 and 600 millimicrons) and red (between 600 and 700 millimicrons). The subjective reproduction of a given color, i.e., a certain distribution of light energy, can be obtained by the reproduction of the same average value of energy density in these three bands.

Any color photographic process necessarily involves the following two steps:

(a) analysis of the colors from the subject, and (b) synthesis of the same colors According to the mode of synthesis, one can distinguish between the additive and subtractive processes. In additive systems, the colors are formed by adding the complementary colors of the three fundamental colors, blue, green and red, found in the original subject. Upon looking at the image, the eye then receives the complementary color of that existing on the print, thereby restituting the original colors. The complementary colors of blue, green and red are yellow, magenta and cyan, respectively. Subtractive systems are practically the only ones still in use for photography.

Color selection can take place in two different manners:

(a) with three filters and a single emulsion sensitive to a broad spectrum in the visible, and (b) with three emulsions sensitive to the three basic colors. In (a), filters can be incorporated into the emulsion in the form of a trichromic frame.

Color selection is usually obtained by using three emulsions, e.g., as in (b), above. Each emulsion is sensitive to a basic color. The emulsions are generally separated by thin transparent layers with or without filter action.

Color synthesis is obtained by selective generation of dyes (the usual case), by modifying dyes already present in the emulsion, by selective discoloration or by selective masking.

The formation of dyes involves a reaction between a developing agent and three complexing agents catalysed by the presence of the photo-reduced silver in the emulsion. This reaction includes three different steps:

(a) developer + n $Ag^+$ → n Ag + oxidized developer (b) oxidized developer + coupler → leuco dye (c) leuco dye + oxidizing agent → dye Suitable developers are paraphenilenediamine derivatives having the general formula:

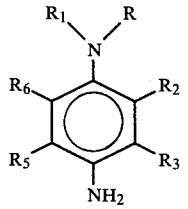

wherein

R and $R_1$ may be the same or different and are selected from lower alkyl groups such as $—CH_3$, $—C_2H_5$, and $—C_3H_7$; and $R_2$, $R_3$, $R_5$ and $R_6$ may be the same or different and are selected from alkyl groups and substituted and unsubstituted aryl groups.

Two types of couplers can be utilized: (a) phenol or naphtol derivatives leading to cyan dyes belonging to the indoaniline group; and (b) methylene derivatives having a methylene activated function and leading to yellow and magenta dyes of the azomethines group.

The reaction mechanism is as follows:

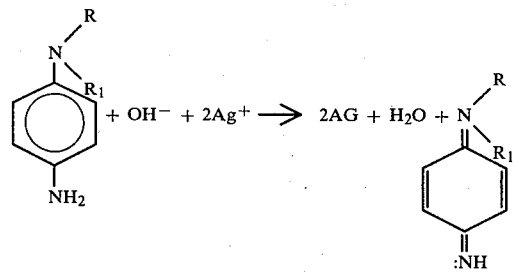

In basic pH, the developer molecule is oxidized by the $Ag^+$ metal ion, thereby giving a diimine quinone ion stabilized by resonance:

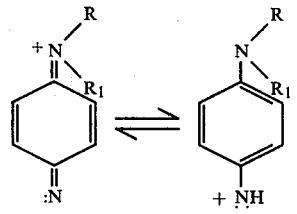

The next step is the reaction of the quinone diimine ion with the coupler ion. In basic pH the coupler is strongly ionized:

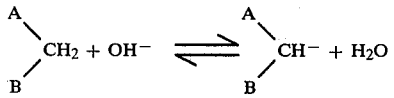

which allows the coupling:

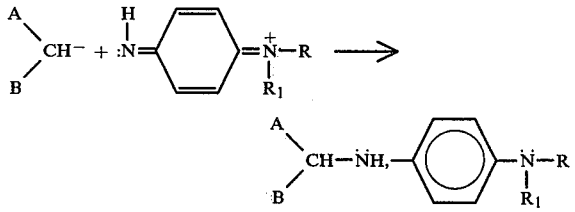

The leuco derivative is then oxidized to form the dye:

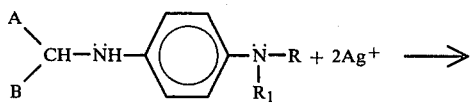

-continued

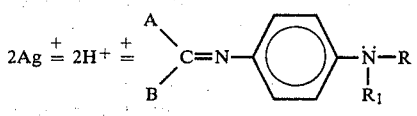

In the above formulae, A and B may be the same or different and can be selected from the following group: $CH_3$, $C_2H_5$, $CH_3SO_2NHC_2H_4$, $C_2H_4OH$ and $C_6H_5$.

Emulsions with multiple layers provide color images by direct processing. The images can be negatives with complementary colors or positives after inversion. The structure is made of three superimposed emulsion layers separated by thin gelatin layers. These emulsions are, starting from the substrate:

(1) a red sensitized emulsion (2) a green sensitized emulsion, and (3) an unsensitized emulsion which is naturally sensitized to the blue.

The red sensitized emulsion is more sensitive than the green which is, itself, more sensitive than the blue, in order to compensate for the light absorbed in the preceding layers.

The unsensitized emulsion receives light first and absorbs the blue forming a latent blue image. The red and green are transmitted through the first layer. The green is absorbed by the second layer which forms a green image and transmits the red which is finally absorbed by the third layer. In order to avoid the transmission of the color corresponding to a sensitized layer to the next one, a dye is incorporated to that emulsion or to the separating layer. Such dyes are eliminated during processing.

The thickness of each sensitive layer may vary from 1 to 3 microns and the separating layers are 0.5 to 1 micron.

The peak sensitivites are:

UV to 450 nm for the blue, 530 nm for the green, and 630 nm for the red.

Unfortunately it is not possible to avoid a general sensitivity to UV.

Each elementary emulsion contains a dye-forming material (Coupler). The external emulsion sensitive to blue contains a yellow coupler; the middle emulsion sensitive to green includes a magenta coupler and the bottom emulsion, sensitive to red, contains a cyan coupler. The three dyes are formed during the processing and appear simultaneously together with the reduced silver. The images in each layer are developed in a color complementary to that for which it has been sensitized, that is:

yellow for blue magenta for green cyan for red

The absorption peaks of the dyes are: p1 yellow: 440 nm magenta: 540 nm cyan: 660 nm Special effects in color photography can generally be classified into 5 types: chromatic, geometrical, diffusion, structural and surface. Chromatic effects produce a color pattern different from the original (e.g. yellow skies, green faces, etc.). Such effects are generally produced by using filters, monochromatic lights during exposure or special processing techniques.

Geometrical effects provide a deformation of the shape of various components in the image (e.g. square wheels, oval faces, wrong perspective, etc.) very similar to the deforming mirrors found in amusement parks. Geometrical effects are obtained by special lenses, gratings, masks used in the exposure camera, duplicator or enlarger.

Diffusion effects provide diffuse edges, subrealistic images, unconventional shadows, etc. Such effects are produced by out-of-focus imaging, wide aperture or masking.

Structural effects can give a mosaic structure, structures similar to alligator skin, wood or other artistic structural effects. Structural effects are produced by double exposure or exposure through various transparent patterns.

Surface effects provide a painting-like finish or a metallic aspect and are produced by spraying the surface of the film or paper with an appropriate spray.

It is noted that all of the methods described above for providing special effects in the photograph require special equipment and/or processing.

The Prior Art

The following patents relating to photographic elements having special effects are known.

U.S. Pat. No. 2,183,393 discloses a process and material for producing three-color photographs. In this patent two emulsion layers are deposited on one side of the support whereas the third emulsion layer is placed on the other surface of the support. Various combinations of sensitizers and couplers are shown in this patent.

U.S. Pat. No. 2,231,685 discloses a film for false-color photography comprising a support and three emulsion layers. According to this patent, the film has at least the top layer uncolored or impermanently colored a light yellow and at least one lower layer colored in a definite relation to its sensititivity.

U.S. Pat. No. 2,763,549 is directed to a multi-layer photographic color film having false coloring characteristics. By false coloring, it is meant that the primary color of the original subject is reproduced by a coloring material other than one which is complementary to the primary color.

U.S. Pat. No. 2,319,984 discloses a color photographic element comprising a support and emulsion layer sensitized to the three primary colors. Various combinations of sensitizers and couplers are shown in the Table on page 2.

U.S. Pat. No. 4,131,464 discloses a false color photographic element comprising four light sensitive silver halide emulsion layers, two of the emulsion layers containing color couplers and the other two free of color couplers.

SUMMARY OF THE INVENTION

The present invention provides a color photographic element having a special chromatic effects. Such special effects are obtained without the use of special equipment and/or processing steps. Thus, a photographer may take pictures with the present photographic film with a conventional camera without using any special filters or chromatic lights, have the exposed films developed by the usual photographic service centers without any instructions for special treatment of the film, and obtain a photograph having special chromatic effects.

It has been found that special chromatic effects in color photographs can be obtained by using a photographic element comprising a support, a red sensitive silver halide emulsion layer, a green sensitive silver halide emulsion layer, a blue sensitive silver halide emulsion layer, the emulsion layers being arranged one behind the other, the emulsion layers containing dye-forming couplers, the couplers being so arranged that:

(1) a coupler is omitted from one of the emulsion layers;

(2) the dye-forming couplers in the emulsion layers are transposed so that the color of the dye formed in at least one of the emulsion layers is different from the complementary color for which that emulsion layer has been sensitized; or (3) a combination of (1) and (2).

In another embodment of the present invention, special chromatic effects in color photographs are obtained by using a photographic element comprising a support and three emulsion layers arranged one behind the other, at least two of the emulsion layers containing a coupler which, upon coupling with an oxidation product of a color developer in the emulsion layer, forms a dye which is either complementary or non-complementary in color to that for which the emulsion layer is sensitized and at least two of the emulsion layers containing no sensitizer.

This invention also provides a process of preparing a photographic element having special chromatic effects. The process comprises depositing on a suitable support layer three emulsion layers. The emulsion layers contain sensitizers and couplers in the combinations as set forth herein.

This invention further provides a process of obtaining color photographic products having special chromatic effects. The process comprises exposing and developing photographic elements comprising a support layer and three emulsion layers, the emulsion layers containing sensitizers and couplers in the combinations as set forth herein.

DETAILED DESCRIPTION OF THE INVENTION

According to the present invention, the photographic element having special chromatic effects comprises a support, a red sensitive silver halide emulsion layer, a green sensitive silver halide emulsion layer, and a red sensitive silver halide emulsion layer, the emulsion layers being arranged one behind the other, with the red sensitive layer being located next to the support layer and the blue sensitive layer forming the outermost emulsion layer. Couplers for forming dyes are present in two or all of the emulsion layers.

Special chromatic effects are obtained by one of the following methods:

(1) a dye-forming coupler is omitted from one of the emulsion layers;

(2) the dye-forming couplers in the emulsion layers are transposed so that the color of the dye formed in an emulsion layer is different from the complementary color for which that emulsion layer has been sensitized;

(3) a combination of methods (1) and (2) above;

(4) a sensitizer is omitted from one of the emulsion layers;

(5) a combination of methods (1) and (4);

(6) a combination of methods (2) and (4); and (7) a combination of methods (1), (2) and (4).

Each of the above methods is discussed in detail as follows:

In the first method, a coupler is omitted from one of the emulsion layers. As a result of the missing coupler, the corresponding color is missing in the image, thus leading to the first kind of special chromatic effect. Accordingly, the following combinations of the emulsion layers and couplers are used to produce this first kind of special chromatic effect:

TABLE I

| Layer | Sensitizer | Coupler (a) | (b) | (c) |
|---|---|---|---|---|
| 1 | Blue | none | yellow | yellow |
| 2 | green | magenta | none | magenta |
| 3 | red | cyan | cyan | none |

In Table I, and all of the Tables herein, layers 1, 2 and 3 represent the emulsion layers furthest, intermediate and closest to the support layer, respectively.

In the second method, each of the three emulsion layers contains a coupler therein. However, the couplers are transposed or intermixed so that the dye formed in at least one emulsion layer has a color which is different from the complementary color for which that emulsion layer has been sensitized. In this method, at least one of the dye-forming couplers is used in the "wrong" emulsion layer to provide a different color, thus causing the corresponding color to be changed in the final image. This is the second type of special chromatic effect. Accordingly, the following combinations of couplers and emulsion layers can be obtained:

TABLE II

| Layer | Sensitizer | Coupler (a) | (b) | (c) | (d) | (e) |
|---|---|---|---|---|---|---|
| 1 | blue | magenta | magenta | cyan | cyan | yellow |
| 2 | green | yellow | cyan | magenta | yellow | cyan |
| 3 | red | cyan | yellow | yellow | magenta | magenta |

The third method represents a combination of the above two methods. In this method, a coupler is omitted from one of the emulsion layers and at least one of the couplers in the remaining emulsion layers forms a color different from the complimentary color for which that emulsion layer has been sensitized. Accordingly, the following combinations of couplers and emulsion layers can be obtained:

TABLE III

| Layer | Sensitizer | Coupler | | | | |
|---|---|---|---|---|---|---|
| | | (a) | (b) | (c) | (d) | (e) |
| 1 | blue | none | none | none | none | none |
| 2 | green | cyan | cyan | magenta | yellow | yellow |
| 3 | red | magenta | yellow | yellow | magenta | cyan |
| | | (f) | (g) | (h) | (i) | (j) |
| 1 | blue | cyan | cyan | yellow | magenta | magenta |
| 2 | green | none | none | none | none | none |
| 3 | red | yellow | magenta | magenta | cyan | yellow |
| | | (k) | (l) | (m) | (n) | (o) |
| 1 | blue | cyan | cyan | magenta | magenta | yellow |
| 2 | green | magenta | yellow | yellow | cyan | cyan |
| 3 | red | none | none | none | none | none |

In a fourth method, a sensitizer is omitted from one of the emulsion layers with the couplers for the three primary colors being present in the emulsion layers. Since silver halides are inherently sensitive to blue, no sensitizer is needed in the layer which is blue sensitive. As a result, according to this method, the sensitizer is omitted from one of the two remaining emulsion layers. The following combinations of the emulsion layers and couplers can be used to produce the fourth kind of special chromatic effect.

TABLE IV

| Layer | Coupler | Sensitizer (a) | Sensitizer (b) |
|---|---|---|---|
| 1 | yellow | none | none |
| 2 | magenta | none | green |
| 3 | cyan | red | none |

In the fifth method, at least one of the red or green sensitive layers contains no sensitizer and a coupler is omitted from one of the emulsion layers. The following combinations of sensitizers and couplers can be used to produce this fifth type of special chromatic effect.

TABLE V-(A)

| Layer | Sensitizer | Coupler (a) | Coupler (b) | Coupler (c) |
|---|---|---|---|---|
| 1 | none | none | yellow | yellow |
| 2 | none | magenta | none | magenta |
| 3 | red | cyan | cyan | none |

TABLE V-(B)

| Layer | Sensitizer | Coupler (a) | Coupler (b) | Coupler (c) |
|---|---|---|---|---|
| 1 | none | none | yellow | yellow |
| 2 | green | magenta | none | magenta |
| 3 | none | cyan | cyan | none |

In the sixth method, the effects of the second and fourth methods are combined. According to this method, only one of the emulsion layers contains a sensitizer and the couplers in the emulsion layers form dyes which are non-complementary in color to that for which the emulsion layer is sensitized. The following combinations can be used:

TABLE VI-A

| Layer | Sensitizer | Coupler (a) | Coupler (b) | Coupler (c) | Coupler (d) | Coupler (e) |
|---|---|---|---|---|---|---|
| 1 | none | magenta | magenta | yellow | cyan | cyan |
| 2 | green | cyan | yellow | cyan | magenta | yellow |
| 3 | none | yellow | cyan | magenta | yellow | magenta |

TABLE VI-B

| layer | Sensitizer | Coupler (a) | Coupler (b) | Coupler (c) | Coupler (d) | Coupler (e) |
|---|---|---|---|---|---|---|
| 1 | none | magenta | magenta | yellow | cyan | cyan |
| 2 | none | cyan | yellow | cyan | magenta | yellow |
| 3 | red | yellow | cyan | magenta | yellow | magenta |

The seventh method is a combination of the first, second and fourth methods. In this method, only one emulsion layer contains a sensitizer and couplers are present in two of the emulsion layers, with those coupler which are present in the emulsion layers forming a dye non-complementary in color to that for which the emulsion layer is sensitized. The following combinations can be used:

TABLE VII-A

| Layer | Sensitizer | Coupler (a) | Coupler (b) | Coupler (c) | Coupler (d) | Coupler (e) |
|---|---|---|---|---|---|---|
| 1 | none | none | none | none | none | none |
| 2 | green | cyan | yellow | cyan | yellow | magenta |
| 3 | none | magenta | cyan | yellow | magenta | yellow |
| | | (f) | (g) | (h) | (i) | (j) |
| 1 | none | cyan | cyan | yellow | magenta | magenta |
| 2 | green | none | none | none | none | none |
| 3 | none | yellow | magenta | magenta | cyan | yellow |
| | | (k) | (l) | (m) | (n) | (o) |
| 1 | none | cyan | cyan | magenta | magenta | yellow |
| 2 | green | magenta | yellow | yellow | cyan | cyan |
| 3 | none | none | none | none | none | none |

TABLE VII-B

| Layer | Sensitizer | Coupler (a) | Coupler (b) | Coupler (c) | Coupler (d) | Coupler (e) |
|---|---|---|---|---|---|---|
| 1 | none | none | none | none | none | none |
| 2 | none | cyan | cyan | magenta | yellow | yellow |
| 3 | red | magenta | yellow | yellow | magenta | cyan |
| | | (f) | (g) | (h) | (i) | (j) |
| 1 | none | cyan | cyan | yellow | magenta | magenta |
| 2 | none | none | none | none | none | none |
| 3 | red | yellow | magenta | magenta | cyan | yellow |
| | | (k) | (l) | (m) | (n) | (o) |
| 1 | none | cyan | cyan | magenta | magenta | yellow |
| 2 | none | magenta | yellow | yellow | cyan | cyan |
| 3 | red | none | none | none | none | none |

Tables I–VII show that different couplers are used in each of the emulsion layers. This does not mean that the same coupler cannot be included in more than one emulsion layer, i.e., the coupler may be used in one, two or three emulsion layers. However, in view of the large number of possible combinations, such combinations are not included in the Tables. Nevertheless, such combinations do form a part of the present invention.

In the present invention, the support layer for the photographic element may be transparent or opaque and is formed of materials known in the art for such use, e.g., cellulose ester such as cellulose triacetate, polyester, and paper. Each of the three emulsion layers contain photo-sensitive silver halides. For the blue sensitive layer, no sensitizer is needed since the silver halide is sensitive to blue. The green sensitive layer contains, in addition to the silver halide, a green sensitizer. Any suitable green sensitizer known in the art may be used. A specific example is phenyl-oxocarbo-cyanineethylsulfocyanate and selenocarbocyanine-dichloroimidazol. As to the red sensitive emulsion layer, it contains photosensitive silver halide and a red sensitizer. The red sensitizer may be selected from those well known in the art. A specific example of such red sensitizers is methyl stearyldiamine-hydroxy-$\gamma$-naphtoylanilide and sulfonated hydroxy-$\beta$-naphtholanilide of octadecyl-$\beta$-naphtylamide.

Couplers which are incorporated in the emulsion layers are those capable of coupling with an oxidation product of a color developer to form a dye. The couplers can be selected from those well known in the art. For yellow couplers, acyl acetanilide compounds can be used. These compounds have the following structural formula:

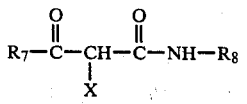

wherein $R_7$ is a tertiary akkyl group, unsubstituted or substituted cycloalkyl group, unsubstituted or substituted aryl group, or unsubstituted or substituted bicycloalkyl group, $R_8$ is an unsubstituted or substituted aryl group or heterocyclic group, and X is a hydrogen atom or a group capable of being split off at the time of coupling.

Magenta couplers useful in this invention include 5-pyrozolone compounds having the following structural formula:

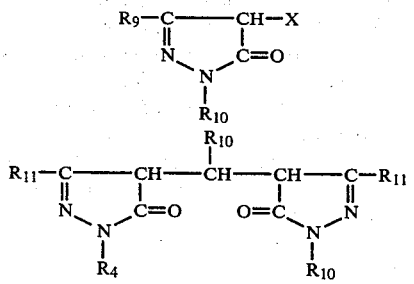

wherein $R_{10}$ is an aryl group or a substituted aryl group, $R_{11}$ is an alkyl group, substituted alkyl group, alkenyl group, substituted alkenyl group, aryl group, substituted aryl group, amino group, substituted amino group, acylamino group, subsubstituted ureido group, sulfonamide group or alkoxy group, $R_9$ is a lower alkyl group or aryl group; and X is a group that can be split off by the oxidation product of an aromatic primary amino compound as a developer, such as a hydrogen atom, halogen atom, cyano group, arylthio group, aryloxy group, arylazo group, heteroazo group or acyloxy group.

In addition to the above-mentioned 5-pyrazolone couplers, other suitable magenta couplers include indazolone compounds, pyrazolone benzimidazole compounds and cyanoacetyl coumarone compounds.

Cyan couplers useful in this invention can be chosen from compounds having the following structural formulae:

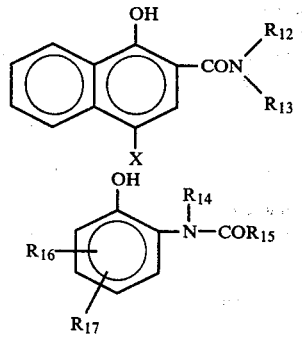

wherein each of $R_{12}$ and $R_{13}$ is a hydrogen atom, an alkyl group or a substituted alkyl group, $R_{14}$ is an alkyl group, substituted alkyl group, aryl group or substituted aryl group; $R_{15}$ is an alkyl group, substituted alkyl group, aryl group, or substituted aryl group; each of $R_{16}$ and $R_{17}$ is a hydrogen atom, halogen atom, lower alkyl group, or alkoxy group; and X is a hydrogen atom, halogen atom, sulfone group, or other atom or group capable of being split off by coupling reaction.

At least two of the emulsion layers contain, in each layer, at least one coupler for a particular color dye, the coupler capable of forming a dye upon coupling with an oxidation product of a color developer in the emulsion layer. In some instances, it may be preferrable to use two or more couplers for the same color dye in each of the emulsion layers.

The amount of silver in each emulsion layer is related to the nature of the dye-forming compound (coupler). The present invention, rather than being based on the replacement of a dye by another, is based on a novel design of each emulsion layer according to the sensitizer-coupler combination.

The photographic element of the present invention, after exposure in a conventional manner without the use of any additional filters, monochromic lights and other equipment, is developed into a negative or positive image having special chromatic effects. The compounds used in developing the present photographic element are those readily available commercially and are well known in the art. Furthermore, the process used in developing the present photographic element is identical to those used in developing conventional color photographic elements. It is an utmost important aspect in the present invention that the instant photographic element requires no special equipment and processing. Since the special effects are built into the photographic element (e.g., film or paper), there is no need for the user to purchase extra equipment, nor does the user incur extra expenses in having the photographic film specially developed.

EXAMPLES

The present invention is further illustrated in the following non-limiting examples.

In a first series of examples, a positive photographic film is used. The ingredients used are as follows:

Green sensitizer: phenyl-oxocarbocyanine-ethylsulfocyanate and selenocarbocyanine-dichloroimidazol Red sensitizer: methylethoxybenzothiazol and diphenylthiazol merocyanine complex Yellow coupler: aminoisophthalic acid-stearoanilidebenzoylacetanilide Magenta coupler: diphenyl-1-sulfonic-ether-3-stearylpyrazolone Cyan coupler: methylstearyldiamine-hydroxy-γ-naphtoylanilide and sulfonated hydroxy-β-naphtolanilide of octadecyl-β-naphtylamide The sensitizers are introduced in the emulsions in the form of a solution 1/1000 in ethylalcohol.

The couplers are introduced in aqueous alkaline solutions containing

| | | | |
|---|---|---|---|
| Coupler 1 | Yellow Coupler | 4.5 | g. |
| | NaOH | 16.2 | ml N-solution |
| | $H_2O$ | 150 | ml (pH:10.1) |
| Coupler 2 | Magenta Coupler | 7.5 | g. |
| | NaOH | 20 | ml N-solution |
| | $H_2O$ | 150 | ml (pH:9) |
| Coupler 3 | Cyan Coupler | 4.5 | g. |
| | NaOH | 9.45 | g. |
| | MetOH | 4.5 | ml |
| | $H_2O$ | 150 | ml (pH:9.8) |
| Coupler 4 | Cyan Coupler | 15 | g. |
| | NaOH | 0.75 | g. |

-continued

| | |
|---|---|
| $H_2O$ | 1.5 ml (pH:9.1) |
| $CH_3OH$ | 150 ml |

The composition of the film is as follows:

| | |
|---|---|
| Blue Sensitive layer | |
| Emulsion (silver halide and emulsifiers) | 1 Kg. |
| Coupler 1 | 417 ml |
| Stabilizer (Sol. 1%) | 30 ml |
| Nekal BX (Sol. 4%)* | 37 ml |
| Thickness of the layer | 5 microns |
| Green sensitive layer | |
| Emulsion | 1 Kg. |
| Sensitizer (Sol. 1/1000) | 80 ml |
| Coupler 2 | 200 ml |
| Stabilizer (Sol. 1%) | 10 ml |
| Pyrocatechol (Sol. 1%) | 6 ml |
| Saponine (Sol. 4%) | 20 ml |
| Thickness of the layer | 5.5 microns |
| Red sensitive layer | |
| Emulsion | 1 Kg. |
| Sensitizer (Sol. 1/1000) | 60 ml |
| Coupler 3 | 336 ml |
| Coupler 4 | 30 ml |
| Stabilizer (Sol. 1%) | 10 ml |
| Pyrocatechol (Sol. 1%) | 6 ml |
| Saponine (Sol. 4%) | 20 ml |
| Thickness of the layer | 9 microns |

*Trademark of General Dyestuff Corp.

The different layers with intermediates are coated on a triacetate base with a doctor blade, with the blue sensitive layer being the layer furthest away from the base and the red sensitive layer closest to the base or support layer.

EXAMPLE 1

Four test runs are made using a photographic positive in which the yellow coupler is omitted from the blue-sensitive layer, the other emulsion layers being the same as shown above. The film is exposed and developed, using conventional equipment and processing methods. Positives having primarily bluish color images are obtained in these runs.

EXAMPLE 2

Four test runs are made using a photographic positive in which the magenta coupler is omitted from the green sensitive layer, the other emulsion layers being the same as shown above. The film is exposed and developed using conventional equipment and processing techniques. Positives having primarily greenish color are obtained.

EXAMPLE 3

Four test runs are made using a photographic positive in which the cyan coupler is omitted from the red sensitive layer, the other emulsion layers being the same as shown above. The film is exposed and developed using conventional apparatus and processing methods. Positives having primarily reddish color are produced.

EXAMPLE 4

Four test runs are made using a photographic positive in which the magenta and yellow couplers are transposed, i.e., the yellow coupler is incorporated in the green sensitive emulsion layer and the magenta coupler is incorporated in the blue sensitive layer. The film is exposed and developed using conventional apparatus and processing methods. The positives so obtained are primarily red in color.

EXAMPLE 5

Four test runs are made in which the cyan and magenta couplers are transposed, i.e., the magenta coupler is incorporated in the red sensitive emulsion layer and the cyan coupler is incorporated in the green sensitive emulsion layer. The film is exposed and developed using conventional apparatus and processing methods. The positives so obtained show a greenish tone.

EXAMPLE 6

Four test runs are made in which the cyan and yellow couplers are transposed, i.e., the cyan coupler is incorporated in the blue sensitive emulsion layer and the yellow coupler is incorporated in the red sensitive emulsion layer. The film is exposed and developed using conventional apparatus and processing methods. The positives obtained show a yellowish tone.

In a second series of examples, a film having negative type emulsions is formed. The sensitizers and couplers used are the same as the first series with the exception that the cyan coupler is methylstearyldiamine-γ-hydroxy-naphtoylanilide.

The sensitizers are introduced in the emulsions in the form of a 1/1000 solution in ethyl alcohol.

The couplers are also introduced in alkaline solutions containing:

| | | |
|---|---|---|
| Coupler 4 | Yellow Coupler | 4.5 g. |
| | NaOH | 16.2 ml N-solution |
| | $H_2O$ | 150 ml (pH:10.1) |
| Coupler 5 | Magenta Coupler | 7.5 g. |
| | NaOH | 20 ml N-solution |
| | $H_2O$ | 150 ml (pH:9) |
| Coupler 6 | Cyan Coupler | 15 g. |
| | NaOH | 9.45 g. |
| | $H_2O$ | 150 ml (pH:9.8) |
| | $CH_3OH$ | 4.5 ml |

The coupler is dissolved in methylalcohol and the NaOH in water and the two solutions are then mixed.

The structure of the film is as follows:

| | |
|---|---|
| Blue sensitive layer | |
| Emulsion | 1 Kg |
| Coupler 4 | 500 ml |
| Stabilizer (Sol. 1%) | 30 ml |
| Nekal BX (Sol. 4%)* | 5 ml |
| Thickness of the layer | 6.5 microns |
| Green sensitive layer | |
| Emulsion | 1 Kg |
| Sensitizer (Sol. 1/1000) | 35 ml |
| Coupler 5 | 200 ml |
| Stabilizer (Sol. 1%) | 30 ml |
| Pyrocatechol (Sol. 1%) | 6 ml |
| Dismulgan T (Sol. 4%)** | 5 ml |
| Thickness of the layer | 4 microns |
| Red sensitive layer | |
| Emulsion | 1 Kg |
| Sensitizer (Sol. 1/1000) | 30 ml |
| Coupler 6 | 330 ml |
| Stabilizer (Sol. 1%) | 30 ml |
| Pyrocatechol (Sol. 1%) | 6 ml |
| Igepal C (Sol. 4%)* | 10 ml |
| Thickness of the layer | 9 microns |

*Trademark of General Dyestuff Corp.
**Trademark of General Dyestuff Corp.

The different layers with intermediate are coated on a triacetate base with a Meyer rod.

For the purpose of this patent disclosure, as well as future reference, the following code will be used:

R for red
B for blue
G for green
M for magenta
Y for yellow
C for cyan
S for sensitizer
K for coupler An arrow → means "changed to," for example:

R → G means that red has been replaced by green, and:

S: R → G means that the red sensitizer has been replaced by a green sensitizer.

Also:

K: M → Y means that a magenta coupler has been replaced by a yellow coupler.

Also, the sign—means that this particular component is missing:

—R means no red
S—R means no red sensitizers
K—M means no magenta coupler
O means no sensitizer Using this code the following emulsions are prepared:

| Example | Modification | Sensitizers Layer 1-2-3* | Couplers Layer 1-2-3 |
|---|---|---|---|
| 7 | S — R | O-G-O | Y-M-C |
| 8 | S — G | O-O-R | Y-M-C |
| 9 | S — G + R | O-O-O | Y-M-C |
| 10 | S:R → B | O-G-O | Y-M-C |
| 11 | S:R → G | O-G-G | Y-M-C |
| 12 | S:B → R | R-G-R | Y-M-C |
| 13 | S:B → G | G-G-R | Y-M-C |
| 14 | S:G → R | O-R-R | Y-M-C |
| 15 | S:G → B | O-O-R | Y-M-C |
| 16 | S:R → B, B → R | R-G-O | Y-M-C |
| 17 | S:B → R, G → B | R-O-R | Y-M-C |
| 18 | S:R → G, G → R | O-R-G | Y-M-C |
| 19 | S:R → B, G → R | O-R-O | Y-M-C |
| 20 | S:R → B, B → G, G → R | G-R-O | Y-M-C |

-continued

| Example | Modification | Sensitizers Layer 1-2-3* | Couplers Layer 1-2-3 |
|---|---|---|---|
| 21 | K:M → Y, Y → M | B-G-R | M-Y-C |

*Layer 1 being the layer furthest away from the base or support layer.

What is claimed is:

1. A color photographic element having special chromatic effects comprising a support, a red-sensitive silver halide emulsion layer, a green-sensitive silver halide emulsion layer, and a blue-sensitive silver halide emulsion layer, the emulsion layers being arranged one behind the other, two of the emulsion layers being provided in each layer with a color coupler which forms a dye non-complementary in color to that for which that emulsion layer is sensitized, the remaining emulsion layer containing no coupler.

2. The photographic element of claim 1 wherein the red-sensitive emulsion layer contains no coupler, the green-sensitive layer contains the coupler which forms a dye non-complementary to green and the blue sensitive layer contains a coupler which forms a dye non-complementary in color to blue.

3. The photographic element of claim 1 wherein the red-sensitive emulsion layer contains a coupler which forms a dye non-complementary in color to red, the green sensitive emulsion layer contains no coupler, and the blue-sensitive emulsion layer contains a coupler which forms a dye non-complementary in color to blue.

4. The photographic element of claim 1 wherein the red-sensitive emulsion layer contains a coupler which forms a dye non-complementary in color to red, the green-sensitive emulsion layer contains a coupler which forms a dye non-complementary in color to green, and the blue sensitive emulsion layer contains no coupler.

5. A process of preparing a photographic element having special chromatic effects comprising depositing on a support three emulsion layers, two of said emulsion layers each containing a coupler and a sensitizer, the coupler being capable of forming a dye non-complementary in color to that for which the emulsion layer is sensitized, the remaining layer containing no coupler.

6. The color photographic element of claim 1, 2, 3 or 4 wherein: the red-sensitive silver halide emulsion layer is disposed on one surface of the support; the green-sensitive silver halide emulsion layer is disposed on top of the red-sensitive layer; and the blue sensitive silver halide emulsion layer is disposed on top of the green sensitive layer.

* * * * *